US006607287B1

(12) United States Patent
Ayala, Jr. et al.

(10) Patent No.: US 6,607,287 B1
(45) Date of Patent: Aug. 19, 2003

(54) BLACK-LIGHT DISPLAY

(75) Inventors: Alfredo M. Ayala, Jr., West Covina, CA (US); Eric C. Haseltine, Burbank, CA (US); Kathleen L. Nelson, Pasadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 256 days.

(21) Appl. No.: 09/665,744

(22) Filed: Sep. 20, 2000

(51) Int. Cl.[7] ..... F21K 27/00

(52) U.S. Cl. ..... 362/259; 362/84; 362/293; 40/543; 372/80; 250/483.1

(58) Field of Search ..... 362/259, 293, 362/34, 84; 40/541, 542, 543; 372/80; 250/483.1, 372

(56) References Cited

U.S. PATENT DOCUMENTS 3,757,106 A 9/1973 Bau et al.
4,006,970 A 2/1977 Slater et al.
4,814,800 A 3/1989 Lavinsky et al.
4,887,197 A 12/1989 Effinger
4,942,504 A 7/1990 Brotz
5,005,110 A 4/1991 Brotz
5,050,056 A 9/1991 Ellison
5,311,335 A 5/1994 Crabtree
5,416,674 A 5/1995 Murai
5,482,510 A 1/1996 Ishii et al.
5,864,417 A 1/1999 Ho
5,988,816 A 11/1999 Quadri
6,114,704 A * 9/2000 Buck ..... 250/372
6,211,526 B1 * 4/2001 Huston et al. ..... 239/585.1

* cited by examiner

*Primary Examiner*—Sandra O'Shea
*Assistant Examiner*—John Anthony Ward
(74) *Attorney, Agent, or Firm*—Hogan & Hartson, L.L.P.; Donald L. Wenskay

(57) ABSTRACT

A black-light display creates dynamic and animated imagery by employing a UV laser system (14, 16, 18) configured to scan a luminescent material (12) to produce a UV-excited static or dynamic image.

19 Claims, 1 Drawing Sheet

BLACK-LIGHT DISPLAY

BACKGROUND OF THE INVENTION

1. Field of the Invention

The present invention relates generally to the field of illumination and more particularly to a light source combined with a separate phosphorescent or fluorescent material for creating static or dynamic images and a method therefor. Although the present invention is subject to a wide range of applications, it is especially suited for use in a black-light display employed in theme parks and other out-of-home venues such as stores, theaters, and location-based entertainments.

2. Description of the Related Art

Black-light displays create black-light effects that have vivid colors that stand out especially well in the dark. Accordingly, conventional black-light effects are commonly used in theme park, theatrical, and other entertainment venues.

Existing black-light displays employ a surface having pre-painted patterns of luminescent material such as phosphorescent or fluorescent materials. An unfocused ultraviolet (UV) illumination source such as a UV lamp is directed at the surface to reveal images that glow when illuminated. These displays typically use pre-painted imagery on the surface and are limited to showing static images. They have not been able to display dynamic or animating imagery in theatrical or large entertainment venues.

Visible lasers have been known to create black-light effects, but they are typically confined to spot light configurations.

Video or film projectors can display dynamic imagery and animation. But, they do not create an effective illusion of self-luminance on projected surfaces because the beams from these projectors are themselves visible due to light scattering.

Broadband video and film projectors are also inefficient at stimulating light-emitting luminescent material because most of the energy in these visible band displays is at wavelengths that are outside the optimum absorption spectrum of luminescent materials.

A need therefore exists for a black-light display, and a method therefor, that is capable of creating dynamic and animated imagery with the benefits of UV illumination such as vivid colors, persistence effects, invisible illumination beams suitable for dark environments, and the illusion of self-luminance.

BRIEF SUMMARY OF THE INVENTION

The invention resides in a black-light display. The black-light display provides advantages over known black-light displays in that it provides dynamic and animated imagery with the benefits of UV illumination, such as vivid colors, persistence effects, invisible illumination beams suitable for dark environments, and the illusion of self-luminance.

The invention provides a UV-excited static or dynamic image. This can be accomplished by a UV laser system configured to scan a luminescent material carried by a substrate. Thus, dynamic and animated imagery is created with the benefits of UV illumination such as vivid colors, persistence effects, invisible illumination beams suitable for dark environments, and the illusion of self-luminance.

The invention can provide hybrid images comprised of light that is part direct reflection and part stimulated luminescence. This can be accomplished by a visible laser system in combination with the UV laser system that is configured to scan the luminescent material to produce a directly visible static or dynamic image.

Other features and advantages of the present invention will be set forth in part in the description that follows and in the accompanying drawings, wherein the preferred embodiments of the present invention are described and shown, and will in part become apparent to those skilled in the art upon examination of the following detailed description taken in conjunction with the accompanying drawings, or may be learned by practice of the present invention. The advantages of the present invention may be realized and attained by means of the instrumentalities and combinations particularly pointed out in the appended claims.

DESCRIPTION OF THE PREFERRED EMBODIMENTS

Figure 1:
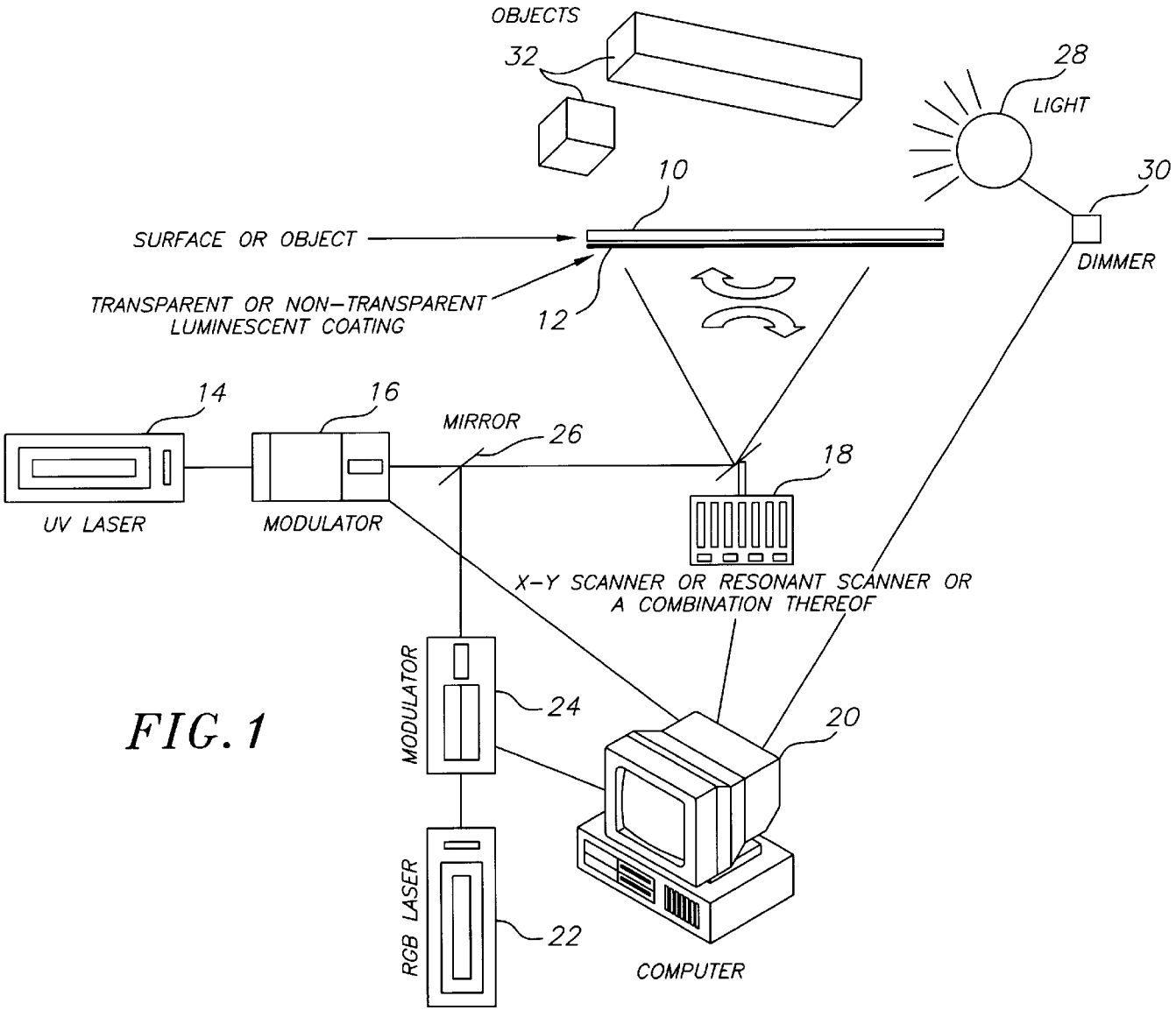
FIG. 1 is a general block diagram of a black-light display configured according to the present invention.

FIG. 1 illustrates a general block diagram of a black-light display configured according to the present invention. The black-light display comprises, in part, a substrate 10, a luminescent material 12 carried by the substrate, and a UV laser system configured to scan the luminescent material to produce a UV-excited static or dynamic image.

The substrate 10 can be composed of plastic, metal, glass, screen, scrim, fabric, ice, water, or another material and combinations thereof that function to carry the luminescent material 12.

The luminescent material 12 can be transparent or colored in visible light. The luminescent material can be a fluorescent material, a phosphorous material, or a combination of both. Examples of luminescent materials suitable for use in this invention are listed in Table 1.

TABLE 1

| Matrix | Composition | Activator(s) | Emission |
|---|---|---|---|
| cadmium activated zinc sulfide | ZnS | Cd | green |
| zinc silicate | $Zn_2SiO_4$ | Mn | green |
| calcium silicate | $CaSiO_3$ | Pb, Mn | pink |
| calcium halophosphates | $Ca_5(PO_4)_3(F,Cl)$ | Sb, Mn | blue to pink |
| strontium magnesium phosphates | $(Sr,Mg)_3(PO_4)_2$ | Sn | pinkish white |
| barium titanium phosphates | $Ba_4Ti(PO_4)_2$ | — | blue-white |
| calcium tungstate | $CaWO_4$ | — | deep blue |
| magnesium tungstate | $MgWO_4$ | — | pale blue |
| magnesium gallate | $MgGa_2O_4$ | Mn | blue green |
| magnesium florogermanate | $MgGeO_6MgF_2$ | Mn | deep red |
| magnesium floroasenate | $Mg_6As_2O_{11}MgF_2$ | Mn | deep red |
| yttrium oxide | Y2O3 | Eu | red |
| yttrium vanadate | $YVO_4$ | Eu | red |
| magnesium aluminate | $RMgAl_{11}O_{19}$ | R = Ce, Tb | green |
| barium magnesium aluminate | $BaMg_2AlO_{27}$ | Mn | blue |

The UV laser system can be tuned to frequencies within the excitation spectrum of the luminescent material. The images are formed when the luminescent material absorbs the Referring to FIG. 1, a suitable UV laser system comprises a UV laser 14 (e.g., DPSS UV laser model 3500) that emits a beam of light withing the excitation range of the luminescent material 12. Further, a modulator 16 modulates the intensity of the beam, a scanner 18 delivers the modulated beam to the luminescent material, and a computer 20 controls the modulator and the scanner.

The modulator can be an acousto-optic modulator (e.g., ISOMET model 1212-2-949) or Pockels cell (e.g., Directed Energy Inc. model IPD 2545).

The scanner can be an X-Y scanner (e.g., General Scanning models G 120-D or G138-D) a resonant scanner, (e.g., Electro Optical Products Corp. model SC-21 or SC-25) or a combination thereof The computer controls the X-Y scanner and modulator in real time, based on image and animation data stored in the computer's memory, in a manner that develops a static or dynamic image on the substrate. In preferred embodiments the scanner includes a pair of small mirrors mounted at right angles to one another. The mirrors are driven very rapidly so that the laser beam reflected off the mirrors moves repeatedly in a predetermined path to illuminate a preselected region. The points in the preselected region are illuminated and refreshed many times per second so that the viewer's eye is tricked through persistence of vision into seeing a continuously existing image. The rapid projection of a sequence of slightly different images can give the illusion of a moving object.

In one embodiment of the invention, the surface of the substrate is coated with a luminescent material that is colorless and stable in visible light. The luminescent coating may be either fluorescent or phosphorescent or a combination of the two. For example, one coating can composed of a phosphor such as cadmium activated zinc sulfide or another compound listed in Table 1, contained in a resin binder. Suitable binders can be acrylic or urethane polymers, and the phosphor concentration may range from ten to forty percent. A second coating consists of a fluorescent dye in an acrylic or urethane binder.

The luminescent coating can be applied in a continuous manner over the entire substrate or discrete areas can be coated to give different effects. For example, the substrate can be completely covered with a phosphorescent coating and specific areas can be overlaid with a fluorescent coating that is transparent to UV radiation so that both luminescent coatings can be simultaneously activated, or any combination thereof. The coatings may be applied by any suitable technique, such as spraying or painting by mechanical means or by an artist. The coatings may be, e.g., between 0.25 mm and 3 mm in thickness, depending on the technique used and the desired effect.

An image is produced when the UV laser system scans the substrate. As the laser scans across the surface of the coated substrate, coated areas emit visible light to produce an image. In areas coated with the fluorescent coating, the color will appear and then disappear as soon as the laser moves away. In the phosphorescent areas, an image will remain. When both coatings have been applied, the color may change after the laser passes. This allows the surface to be reused multiple times. A different image may appear each time the pattern of the laser scan is reprogrammed.

The present invention may be embodied in other and different embodiments, and its several details are capable of modification. Where appropriate the same reference numerals are used to avoid unnecessary duplication and description of similar elements already referred to and described above. Only the significant differences of the second embodiment as compared to the first embodiment will be discussed hereafter.

According to a second embodiment configured according to the present invention, the substrate is coated with a luminescent material that is transparent or non-transparent and stable in visible light, and both UV lasers and visible lasers are capable of generating images on surfaces. The coating employed has a similar composition to those in the previously described embodiment. The luminescent material, however, can be colored when viewed in visible light.

Referring to FIG. 1, a visible laser system is configured to scan the coated surface to produce a directly visible static or dynamic image on the coated surface. A visible laser 22 can be of a red-blue-green type (e.g., Laser Physics, Inc. model Reliant 300 WC Kr/Ar) or a monochromatic type (e.g., Laser Physics, Inc. model Reliant 1000M Ar). The outputs of the UV laser and visible laser can be-independently introduced into separate acousto-optic modulators or Pockels cells (16,24) and then combined via a mirror 26 to deliver both visible and non-visible beams to the same scanner.

In yet another embodiment configured according to the present invention, a transparent UV-absorbing, light-emitting phosphor 12 is coated onto a scrim or transparent surface 10, such as glass or plastic, or is admixed in water or ice. A dimmer light 28 is located opposite the coated surface. When the light, whose brightness is computer controlled via a dimmer 30, is brought to full brightness, objects 32 behind the scrim or transparent surface are clearly seen, and the scrim or transparent surface is not seen. But when the visible light is dimmed in concert with the UV laser excitation of the phosphor, a vivid, dynamic image will appear to float in mid-air.

In conclusion, the black-light display described herein provides dynamic and animated imagery with the benefits of UV illumination, such as vivid colors, persistence effects, invisible illumination beams suitable for dark environments, and the illusion of self-luminance. This is primarily accomplished by dynamically scanned and modulated UV radiation. Furthermore, it provides hybrid images comprised of light that is in part direct reflection and in part stimulated luminescence. This is primarily accomplished by combining visible laser energy with UV radiation in a single projected beam that is dynamically scanned and modulated.

Those skilled in the art will recognize that other modifications and variations can be made in the black-light display of the present invention and in the construction and operation of this black-light display without departing from the scope or spirit of this invention.

What is claimed is:

1. A black-light display for creating dynamic and animated imagery, the black-light display comprising:

a substrate;

a luminescent material carried by the substrate;

a UV laser for emitting a beam of light within the excitation range of the luminescent material; and a scanner configured to deliver the beam to the luminescent material and configured to scan the luminescent material to produce a UV-excited static or dynamic image.

2. The black-light display of claim 1, wherein the substrate is composed of plastic, metal, glass, screen, scrim, ice, fabric, or water.

3. The black-light display of claim 1, wherein the luminescent material is transparent.

4. The black-light display of claim 1, wherein the luminescent material is colored in visible light.

5. The black-light display of claim 1, wherein the luminescent material is a fluorescent material.

6. The black-light display of claim 1, wherein the luminescent material is a phosphorous material.

7. The black-light display of claim 1, wherein the luminescent material is a combination of a fluorescent material and a phosphorous material.

8. The black-light display of claim 7, wherein the luminescent material includes:

a first coating comprising a phosphor contained in a resin binder; and a second coating comprising a fluorescent dye contained in an acrylic or urethane binder.

9. The black-light display of claim 8, wherein:

the first coating substantially covering an entire surface of the substrate;

the second coating overlays the first coating at preselected areas of the surface.

10. The black-light display of claim 8, wherein:

the phosphor is cadmium activated zinc sulfide, zinc silicate, calcium silicate, calcium halosphosphates, strontium magnesium phosphates, barium titanium phosphates, calcium tungstate, magnesium tungstate, magnesium gallate, magnesium florogermanate, magnesium floroasenate, yttrium oxide, yttrium vanadate, magnesium aluminate, or barium magnesium aluminate; the resin binder is acrylic or urethane polymers.

11. The black-light display of claim 8, wherein the phosphor concentration of the first coating is from about ten percent to about forty percent.

12. The black-light display of claim 1, wherein the luminescent material is continuous over a surface of the substrate.

13. The black-light display of claim 1, wherein the luminescent material is on a discrete area of a surface of the substrate.

14. The black-light display of claim 1, further comprising:

a modulator for modulating the intensity of the beam; and a computer for controlling the modulator and the scanner based on image and animation data stored in a memory of the computer.

15. The black-light display of claim 1 further comprising: a visible laser system configured to scan the luminescent material to produce a directly visible static or dynamic image.

16. The black-light display of claim 1 further comprising:

a dimmer light, wherein the substrate is disposed between the dimmer light and the UV laser system.

17. A black-light display for creating dynamic and animated imagery, the black-light display comprising:

a surface;

a luminescent material that is colorless when viewed in visible light, the luminescent material including, a first coating comprising a phosphor contained in a resin binder, the first coating substantially covering the entire surface, and a second coating comprising a fluorescent dye contained in an acrylic or urethane binder, the second coating overlaying the first coating at preselected areas of the surface;

a UV laser for emitting a beam of light within the excitation range of the luminescent material; and a scanner configured to deliver the beam to the luminescent material and configured to scan the luminescent material to produce a UV-excited static or dynamic image.

18. A black-light display for creating dynamic and animated imagery, the black-light display comprising:

a surface;

a luminescent material that is colored when viewed in visible light, the luminescent including, a first coating comprising a phosphor contained in a resin binder, the first coating substantially covering the entire surface, and a second coating comprising a fluorescent dye contained in an acrylic or urethane binder, the second coating overlaying the first coating at preselected areas of the surface;

a UV laser for emitting a beam of light within the excitation range of the luminescent material; and a scanner configured to deliver the beam to the luminescent material and configured to scan the luminescent material to produce a UV-excited static or dynamic image.

19. A black-light display for creating dynamic and animated imagery, the black-light display comprising:

a transparent surface;

a transparent UV-absorbing, light-emitting phosphor coated onto the transparent surface;

a UV laser system configured to scan the transparent UV-absorbing, light-emitting phosphor to produce a UV-excited static or dynamic image; and a dimmer light located opposite the coated surface.

* * * * *